US005390802A

United States Patent [19]

Pappagallo et al.

[11] Patent Number: 5,390,802

[45] Date of Patent: Feb. 21, 1995

[54] SHELF ASSEMBLY FOR GONDOLA DISPLAY STRUCTURE

[75] Inventors: Larry Pappagallo, Wayne; Jim Sweeney, Belvidene, both of N.J.

[73] Assignee: HMG Worldwide In-Store Marketing, Inc., New York, N.Y.

[21] Appl. No.: 205,901

[22] Filed: Mar. 2, 1994

Related U.S. Application Data

[63] Continuation-in-part of Ser. No. 17,280, Feb. 12, 1993.

[51] Int. Cl.[6] ..... A47F 1/04

[52] U.S. Cl. ..... 211/59.3; 211/187

[58] Field of Search ..... 211/186, 187, 59.2, 211/59.3, 184, 153, 151, 175, 189, 90

[56] References Cited

U.S. PATENT DOCUMENTS

| | | | |
|---|---|---|---|
| 3,054,511 | 9/1962 | Erismann | 211/187 X |
| 3,248,079 | 4/1966 | Kennedy | 211/187 X |
| 4,154,419 | 5/1979 | Breidenbach | 211/187 X |
| 4,519,508 | 5/1985 | Gullett et al. | 211/187 X |
| 4,669,692 | 6/1987 | Mastrodicasa | 211/187 X |
| 4,729,485 | 3/1988 | Kulbersh | 211/184 |
| 4,881,708 | 11/1989 | Walter | 211/153 X |

*Primary Examiner*—Blair M. Johnson

*Attorney, Agent, or Firm*—Cohen, Pontani, Lieberman & Pavane

[57] ABSTRACT

A shelf assembly for use with a gondola display structure comprises a bracket assembly selectively engageable with the vertically spaced slots of the gondola upright and securable at one of a plurality of selected angular orientations relative thereto. A merchandise supporting surface is slidably coupled to the bracket assembly and is slidable into a plurality of positions relative to the forward facing surface of the gondola to compensate for the effect that changes in the angular orientation have on the appearance of the merchandise supported thereon. Transversely slidable dividing members are provided to accommodate, for example, items of different width on a single shelf.

17 Claims, 4 Drawing Sheets

SHELF ASSEMBLY FOR GONDOLA DISPLAY STRUCTURE

RELATED APPLICATIONS

This application is a continuation-in-part of U.S. patent application Ser. No. 08/017,280, filed on Feb. 12, 1993, and entitled DISPLAY APPARATUS. The contents of the aforementioned application are expressly incorporated herein by reference.

BACKGROUND OF THE INVENTION

1. Field of the Invention

The present invention relates to shelving in general, and more particularly to merchandise display shelving, also called gondola shelving.

2. Discussion of the Prior Art

Gondola display shelving is widely used in marketing to display goods or items for sale in a manner appealing to the average consumer. Typically, a gondola display rack includes a floor contacting base, a pair of upright members extending vertically from the rear of the base, and shelves connected to the uprights cantilevered over the base. The shelves may be oriented substantially horizontally or may be tilted slightly, downwardly and forwardly, to produce a gravity type feed of product thereon. These types of display racks are commonly employed to display, for sale, packaged items such as pantyhose and the like. A display utilized in this manner is commonly referred to in the industry as a "point of purchase" display.

A common problem associated with conventional gondola displays is that they do not address the need to accommodate products of varying dimensions on a single shelf. That is, the shelves of such displays generally include a number of fixed dividers which are uniformly spaced relative to one another to define a plurality of columns of the same width. Although items which are significantly narrower than such columns may be positioned between the dividers, such items tend to move out of position within the column. The resulting lack of uniformity of items within the column detracts from the overall appearance of the display. Conversely, where the column is too narrow to accommodate a particular item, the shelf must be replaced with a shelf having the required divider spacing or with one having no dividers at all. Even where use of the shelf is limited to situations in which all of the items thereon are of the same width, the presence of fixed dividers can preclude re-use of the shelf, i.e. the shelf can not accommodate items having a width different than that of the items previously stored thereon.

Another common problem which typical gondola displays share is that the use of downwardly and forwardly tilted shelves makes it difficult to count the product within each column as is necessary when store personnel are taking inventory or deciding whether to reorder merchandise.

Yet another problem associated with these types of gondola displays is the fact that where the shelves permit adjustments in angular orientation, there is no adequate mechanism to compensate for the resulting change in the positions of the shelves relative to one another. Specifically, gondola display shelves of the prior art do not permit the spacing between the shelf and the gondola upright to be adjusted in response to modifications in the angular orientation of the shelf. Such adjustment is desirable to prevent one shelf from excessively obscuring the consumer's view of the contents of the shelf below it. Instead, in order to provide the desired spacing between the shelves of the prior art and thereby optimize the appearance of the merchandise to the consumer, it is necessary to move the shelves closer or farther apart by adjusting the vertical spacing therebetween. That is, the shelf must be physically removed and its brackets repositioned within another set of upright slots.

Still another disadvantage of most prior art gondola shelves is that they employ supporting brackets made integral thereto, such as by welding. Such construction presents a geometry which is inefficient for packing and shipping purposes.

Accordingly, it is an object of the present invention to provide a gondola display shelf which is capable of accommodating products of varying dimensions at the same time.

It is another object of the present invention to provide a shelf which is movable relative to the gondola uprights to allow store personnel to quickly ascertain the number of items within each column of the display and which facilitates rapid restocking.

It is yet another object of the present invention to provide a shelf which is economical to manufacture and which presents a geometry which is efficient for packing and shipping purposes.

SUMMARY OF THE INVENTION

The aforementioned objects, as well as other benefits and advantages which will become apparent to those skilled in the art are provided by a gondola rack shelf assembly comprising bracket means selectively engageable with the vertically spaced slots of a gondola upright and selectively angularly positionable relative thereto. The shelf assembly also includes a merchandise organization module defining at least one merchandise supporting surface and including movable dividing means sliceable transversely relative to the merchandise supporting surface for accommodating merchandise of varying widths. The shelf assembly of the present invention further includes support means slidably secured to the bracket means for supporting the merchandise organization module and for positioning the module at a selected distance from the gondola upright. Additionally, the shelf assembly of the present invention includes locking means for retaining the support means in a desired position relative to the bracket means and the upright.

The bracket means includes a transverse member which defines an axial opening at respective ends thereof and first and second bracket assemblies. Each bracket assembly has an elongate section selectively positionable within the transverse member and a flange section engageable with the slots of the upright, whereby the distance between said flange sections may be adjusted to accommodate uprights of various dimensions and slot spacings. The flange section of each bracket assembly has a rearwardly projecting portion insertable into one of the vertically spaced slots and a downwardly depending portion. Each bracket assembly further includes retaining means secured to the downwardly projecting portion and selectively pivotable relative thereto for engaging a selected surface of the upright and thereby retaining said bracket means in a selected angular orientation, whereby the module may be oriented horizontally or tilted downwardly and forwardly at a desired angle.

In accordance with the illustrative embodiment of the present invention, the rearwardly projecting portion of the bracket assembly flange is disposed in a vertical plane and defines a plurality of transverse notches on a lower surface thereof. The range of bracket orientation is established by adjusting the spacing between a rear edge of the downwardly depending portion and the upright. The spacing is adjusted by inserting the rearwardly projecting portion to a predetermined depth within the upright slot and aligning one of the transverse notches with an interior wall of an upright slot.

The downwardly depending portion of the bracket assembly flange defines an aperture and the retaining means comprises a plate member having at least one surface engageable with the gondola upright and defining a slot alignable with the aperture. A fastening means is insertable into the slot and aperture so that the plate member and flange may be maintained in a desired alignment and relative orientation. In accordance with the illustrative embodiment of the present invention, the plate member includes an upwardly angled portion having an edge surface which is adapted to engage the surface of the gondola upright and maintain the shelf in a desired angular orientation relative thereto. The upwardly angled portion preferably defines a transverse notch extending across an edge surface thereof.

The bracket means includes a pair of parallel rails which are adapted to extend away from the gondola upright. The support means includes first and second channel members dimensioned and arranged to slidably receive the rails. Accordingly, the distance of the rear edge of the support means relative to the gondola upright may be selectively adjusted in response to adjustments in angular orientation of the bracket means to thereby maintain a desired facing of product to the consumer. Moreover, the support means may be slid out to its outermost position to permit restocking, inventory counting of product, or the like.

The rails are mounted on a pair of parallel bracket members, each of the bracket members having an inwardly directed face. The underside of the bracket members are provided with aligned, spaced apart notches. The locking means includes a wire grid pivotably secured to the channel members and biasing means for biasing the wire grid into engagement with an aligned pair of the spaced apart notches on the underside of the bracket members. Preferably, the support means also comprises a rectangular frame secured to the channel members. The rectangular frame includes a pair of laterally extending sections which define respective lateral support surfaces and a pair of side sections which interconnect the laterally extending sections and which define a respective vertical support surface.

The merchandise organization module includes a pair of transversely extending track members supported by the rectangular frame of the support means. To this end, each track member has a first axial channel on a lower surface thereof for receiving the laterally extending sections of the rectangular frame. Each track member further includes a second axial channel along its upper surface for receiving a corresponding tab that extends downwardly from each end of the dividing members. The dividing means comprises a plurality of dividing members, each dividing member including a base section having a downwardly extending tab at each end and a panel section extending upwardly from said horizontal section. Each pair of dividing member tabs is slidably positionable within the upper channel of the track members so that the dividing members may be moved relative to one another to define a plurality of columns of different widths and to thereby accommodate merchandise of varying dimensions.

The merchandise organization module further comprises a pusher assembly that includes a channel section having a spring biased pusher slidably disposed thereon and downwardly extending tabs at opposite ends thereof. Each respective pusher assembly tab is insertable within a corresponding track member upper channel. As such, the pusher assemblies are also slidably positionable so that their position relative to one or more dividing members may be maintained or adjusted as desired.

The improved gondola display of this invention has many advantages over prior art gondola displays. Among those advantages is that all product supported within the merchandise organization module of the display is gravity fed to the forward edge of shelf. As such, capacity of the display is greatly increased and access to product located in the display is substantially improved. Additionally, the use of a fixed frame with a locking, slide out merchandise module support permits the shelf to be more quickly loaded with packages of products and enables inventory to be counted much more rapidly than has been possible heretofore. Moreover, the use of slidably positionable dividing members and pusher assemblies permits products of different widths to be accommodated on the same shelf, thereby facilitating greater flexibility of product mix within the display.

Further, the improved bracket assemblies of the present invention make it possible to adjust the width of the shelf to accommodate gondola uprights of different widths and slot spacings. The construction of the bracket assemblies also permits the shelf to be supported either in a horizontal orientation or in a desired downwardly and forwardly tilted orientation.

The distance of the module support section from the gondola upright and the angular orientation of the bracket support can be modified as desired to provide a wide variety of shelf presentations.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

DETAILED DESCRIPTION OF THE PREFERRED EMBODIMENTS

Figure 1:
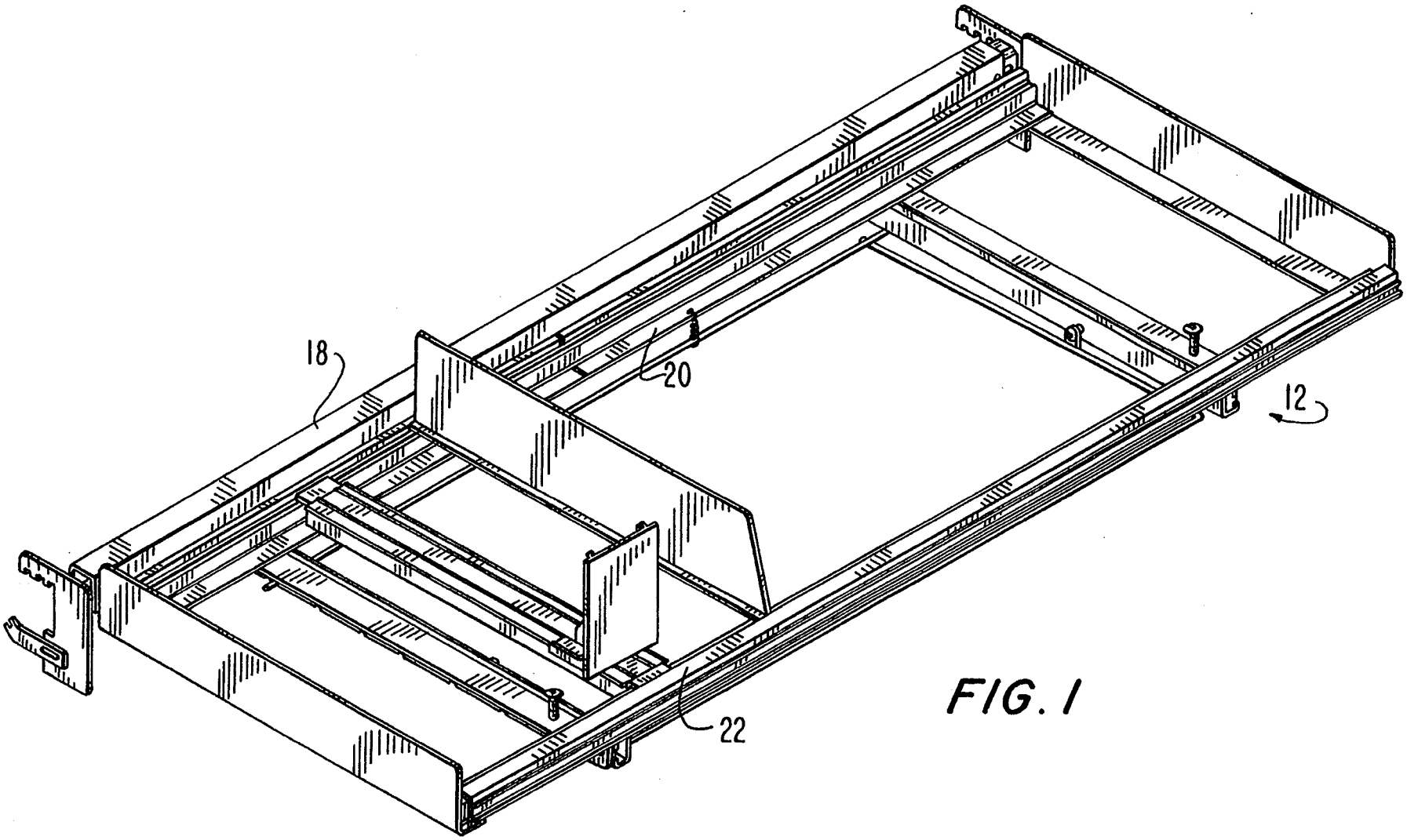
FIG. 1 is a perspective view of a shelf assembly constructed in accordance with the present invention.

With reference to FIG. 1, there is illustrated a shelf assembly generally indicated at 12 and constructed in accordance with the present invention. It is contemplated that shelf assembly 12 may be secured to any suitable gondola display rack structure, such as the one described in the aforementioned U.S. patent application Ser. No. 08/017,280. As is well known, gondola display structures generally include a floor contacting base, a base shelf atop the base, and a pair of vertical gondola uprights which extend upwardly from the rear of the base and which each have a plurality of vertically spaced slots.

As shown in FIG. 1, shelf 12 includes an adjustable bracket assembly 18 securable to the gondola uprights, a locking support assembly 20 slidably secured to bracket assembly 18, and a merchandise organization module 22 supported by support assembly 20. Each of these components will be individually described in detail.

Figure 2:
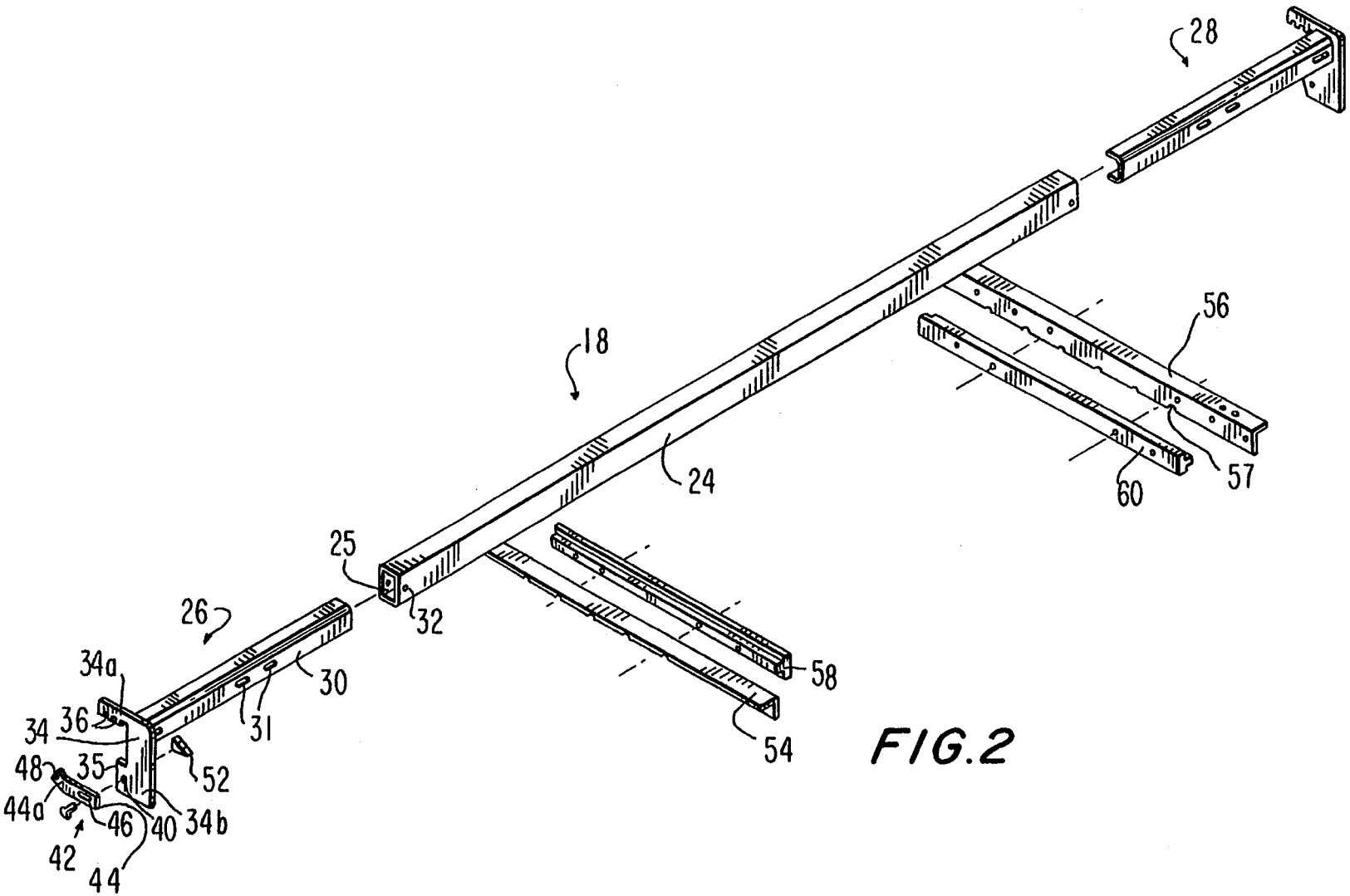
FIG. 2 is an exploded perspective view depicting the bracket assembly portion of the present invention.

With reference now to FIG. 2, there is shown an exploded perspective view of adjustable bracket assembly 18. As shown, adjustable bracket assembly 18 comprises an elongate beam member 24 having an axial opening at each end for accommodating first and second bracket securing assemblies 26 and 28, respectively. Because the construction of each bracket assembly is identical, only securing assembly 26 will be described in detail herein. With continuing reference to FIG. 2, it will be seen that bracket securing assembly 26 comprises an elongate portion 30 which is dimensioned and arranged to be received within the axial opening 25 of beam member 24. Elongate portion 30 is provided with a plurality of spaced apertures 31 which are individually alignable with a similar aperture 32 extending through each end of beam member 24. When elongate portion 30 is positioned within beam member 24 such that one of the apertures 31 therein is aligned with aperture 32, a pin or other suitable locking means (not shown) may be inserted therein to retain the two members in coaxial relation. In this manner, the width of bracket assembly 18 may be adjusted to accommodate the specific spacing between the columns of slots of the gondola uprights. For additional flexibility, a plurality of such securing assemblies, each having an elongate section 30 of a different length, may be fabricated. The securing assemblies so constructed can be easily interchanged to accommodate the different slot spacings and gondola rack widths which may be encountered.

As indicated above, a principal objective of the present invention is to provide a shelf which can be selectively configured into a horizontal orientation, or tilted downwardly and forwardly at any one of a plurality of desired angular orientations for gravity feed. To this end, each bracket securing assembly further includes an inverted L-shaped flange member 34. The base portion 34*a* of flange member 34 extends rearwardly relative to elongate portion 30 and, for a purpose which will soon be explained, defines on its lower surface a plurality of evenly spaced notches 36. The vertical portion 34*b* of flange member 34 depends downwardly from the base portion and defines an aperture 40. The range of bracket orientation is established by adjusting the spacing between the rear edge 35 of depending portion 34*b* and the upright. As will be readily appreciated by those skilled in the art, the aforementioned spacing is adjusted by inserting rearwardly projecting portion 34*a* into the upright slot and aligning one of the transverse notches 36 with the lower interior wall of an upright slot. Alignment with the rearwardmost notch will provide the greatest distance between the gondola upright and rear edge 35 and therefore defines the largest range of angular movement. Conversely, selection of the forward notch will produce the shortest distance and thus the smallest range of angular movement.

In order to retain the shelf 12 of the present invention in a particular angular orientation within the range of movement selected, bracket assembly 18 further includes retaining means 42. Retaining means includes plate member 44 which defines a slot 46 alignable with aperture 40 and which has an upwardly angled portion 44*a*. Fastening means, which may be in the form of threaded screw 50 and nut 52, are insertable into slot 46 and aperture 48. In accordance with the desired shelf orientation, plate member 44 may be selectively positioned to extend a predetermined distance beyond the rear edge 35 of flange section 34 and at a predetermined angle relative thereto. As will be readily ascertained by those skilled in the art, the position of plate member 44 is maintained by the fastening means and determines the specific angular orientation of the shelf assembly 12. Slot 46 permits plate member 44 to be repositioned relative to flange section 34 when the spacing between the front facing surface of the gondola upright and rear edge 35 has been modified, for example. The upwardly angled edge of portion 44*a* defines a transverse notch 48 which is adapted to engage the upper peripheral wall of a gondola upright slot when it is desired to lock shelf assembly 12 in a horizonal orientation relative to the floor. The lower edge surface of upwardly angled portion 44*a* is adapted to engage the forward facing surface of the gondola upright when it is desired to lock shelf assembly 12 in a downwardly and forwardly tilted orientation. It will thus be apparent to those skilled in the art that the geometry of plate member 44 and the length of the slot is flexibly adapted to support the bracket assembly in a large number of angular orientations.

Bracket assembly 18 further includes a pair of elongated parallel members 54 and 56 coupled to beam member 24. As seen in FIG. 2, members 54 and 56 extend forwardly and away from beam member 24 and support parallel rails 58 and 60, respectively. For a purpose which will be explained later, the lower surface of each member 54, 56 is provided with a plurality of aligned, spaced-apart arcuate notches 57.

Figure 3:
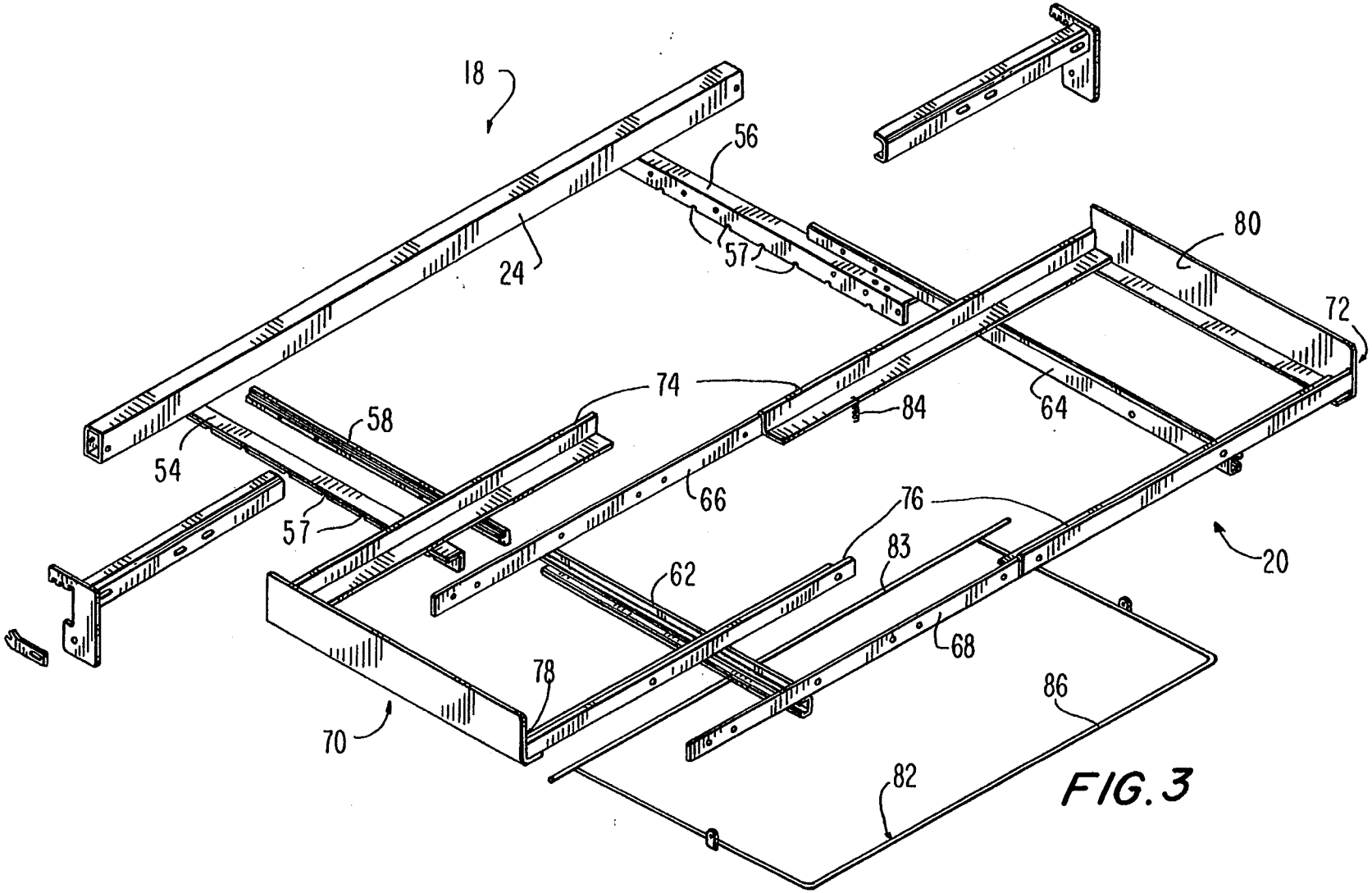
FIG. 3 is an exploded perspective view illustrating the arrangement of the locking support assembly with respect to the bracket assembly of the present invention.

With reference now to FIG. 3, the arrangement of locking support assembly 20 with respect to bracket assembly 18 is illustrated and will now be described in detail. As seen in FIG. 3, support assembly 20 includes first and second channel members 62 and 64 dimensioned and arranged to slidably receive a corresponding one of rails 58 and 60. Transversely disposed on and interconnecting channel members 62 and 64 are parallel elongated plate members 66 and 68. As shown, plate members 66 and 68 support first and second U-shaped frame members 70 and 72 which together define a pair of transverse support surfaces 74 and 76 and a pair of vertical support surfaces 78 and 80.

As indicated above, support assembly 20 is slidable relative to bracket assembly 18 so that the merchandise organization module 22 (FIG. 1) disposed thereon may be slid out into a forwardmost position to facilitate restocking or, as will now be explained, into any one of a plurality of intermediate positions to optimize the position of the associated module relative to those modules directly above and below it. In order to maintain the support assembly in a desired position, a locking grid 82 pivotably connected to channels 62 and 64 is provided. The rear section 83 of locking grid 82 is biased by spring 84 into engagement with a selected pair of aligned notches 57. As will be readily ascertained by those skilled in the art, by pulling up on the forward section 86 of grid 82, rear section 83 is moved out of engagement with notches 57 and the support assembly 20 may be pushed rearwardly or pulled forwardly into a different position. Accordingly, the distance of the rear edge of the assembly 20 relative to the gondola upright may be selectively adjusted in response to adjustments in angular orientation of the bracket means to thereby maintain a desired facing of product to the consumer.

Figure 4:
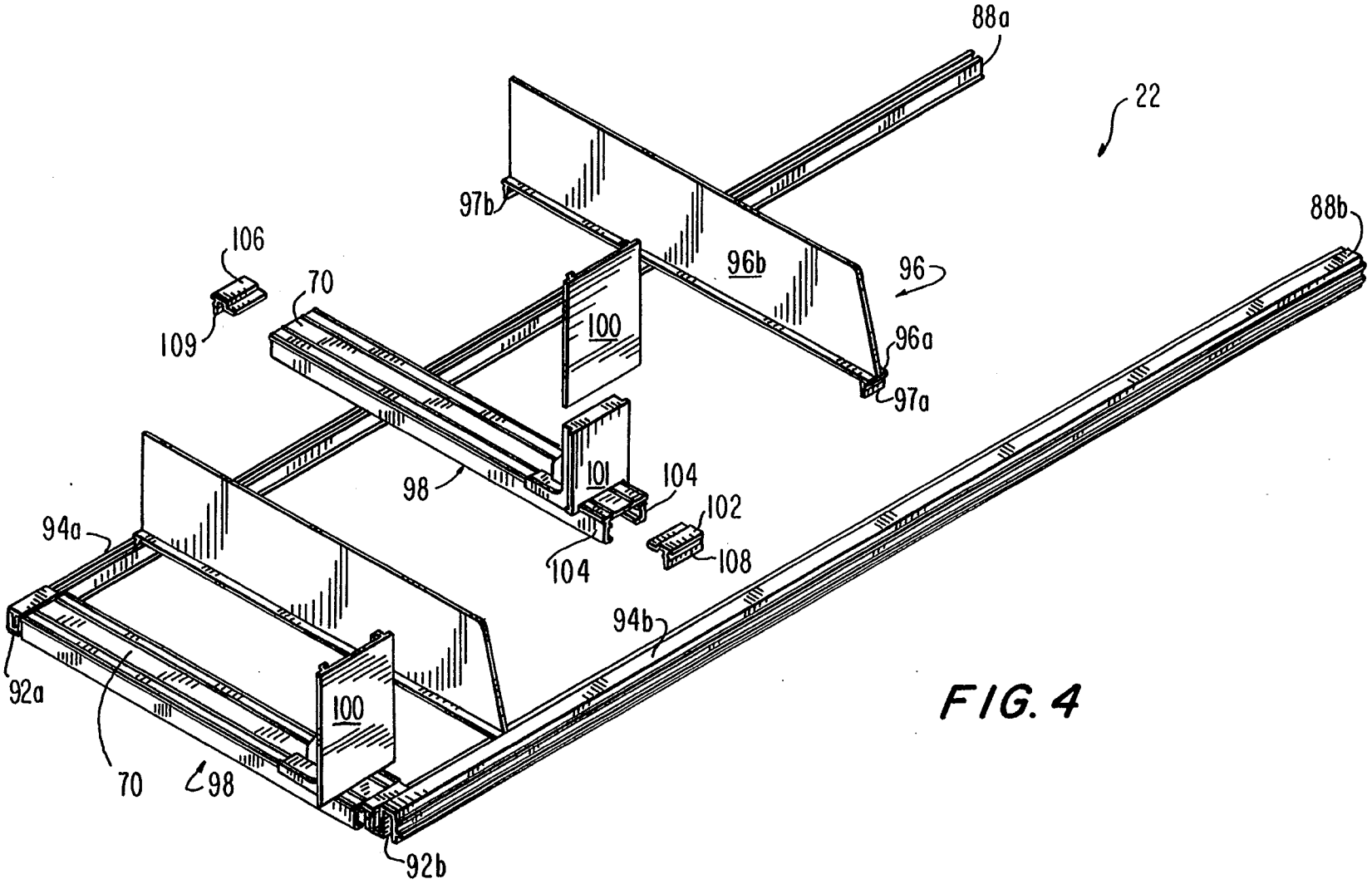
FIG. 4 is an exploded perspective view showing the construction details of a merchandise organization module constructed in accordance with the present invention.

Turning now to FIG. 4, the construction of the merchandise organization module 22 of shelf assembly 12 will now be described. As indicated, module 22 is supported by support assembly 20 and is movable therewith relative to bracket assembly 18 and the gondola uprights to which it is attached. Specifically, module 22 includes a pair of transversely extending track members 88*a* and 88*b* which are supported by the transverse support surfaces 74 and 76 of support assembly 20. To this end, each track member has a first axial channel, 92*a* and 92*b*, respectively, on a lower surface thereof for receiving the upper portions of the U-shape frame members that define transversely extending support surfaces 74 and 76. For a purpose which will soon be described, each track member further includes a second axial slot 94*a* and 94*b* along its upper surface.

Module 22 further includes a plurality of dividing members 96 which may be moved relative to one another to define a plurality of columns of different widths and to thereby accommodate merchandise of varying dimensions. For clarity, only two dividing members are depicted in FIG. 4. As shown, each dividing member includes a base portion 96*a* having front and rear downwardly extending tabs 97*a* and 97*b* and a vertical panel 96*b* extending upwardly from base portion 96*a*. Tabs 97*a* and 97*b* are slidably positioned within axial channels 88*a* and 88*b*, respectively, to permit movement of the dividing member in the manner indicated above.

Each merchandise organization module 22 further comprises a plurality of spring biased pusher assemblies 98 which are advantageously disposed between dividing members and which facilitate the constant front facing of product within the column defined thereby. The internal construction of the pusher assemblies has been omitted, the same having been disclosed in previously discussed U.S. patent application Ser. No. 08/017,280, the contents of which have been incorporated herein by reference. As presented therein, pusher assembly 98 includes a vertical pusher plate adapted to slide on a base. A bias spring (not shown) has its first end affixed to pusher plate support 101, extends forwardly about a pulley (not shown) affixed to front end cap 102, and extends backwards between the legs of the base whereby its second end is affixed to rear end cap 106. The spring provides tension to pull the pusher plate forward on the base to drive products placed on the base in front of the pusher plate towards the front of a shelf upon which the pusher assembly sits. Extending downwardly from end caps 102 and 106 are tabs 108 and 109, respectively. These enable pusher assembly 98 to be slidably positioned in the same manner as dividing members 96. It will thus be apparent that the width of each column defined by the dividing members 96 can be changed as desired and that in response to such changes the pushing assembly 98 can be easily moved so that it remains centrally positioned therewithin.

Those skilled in the art will recognize changes and modifications which can be made to the present invention without departing from its spirit or scope. Accordingly, the scope of the present invention is to be limited only by the appended claims.

What is claimed is:

1. A shelf assembly for supporting merchandise on a gondola display rack, said rack having at least one vertically extending upright defining a column of vertically spaced slots therein, comprising:

bracket means selectively engageable with the slots of the upright and selectively angularly positionable relative thereto, said bracket means including a transverse member defining an axial opening at respective ends thereof and first and second bracket assemblies having an elongate section selectively positionable within said transverse member and a flange section fastened to the elongate section and engageable with the slots of the upright whereby the distance between said flange sections may be adjusted to accommodate uprights having various widths and various spacings between columns of slots thereof:

a merchandise organization module defining at least one merchandise supporting surface for accommodating merchandise varying widths;

support means slidably secured to said bracket means for supporting said merchandise organization module and positioning said module at a selected distance from the upright; and locking means for retaining said support means in a desired position relative to said bracket means and the upright.

2. A shelf assembly for supporting merchandise on a gondola display rack, said rack having at least one vertically extending upright defining a column of vertically spaced slots therein, comprising:

bracket means selectively engageable with the slots of the upright and selectively angularly positionable relative thereto, said bracket means comprising first and second bracket assemblies, each of said bracket assemblies including a flange section having a rearwardly projecting portion insertable into one of said vertically spaced slots and a downwardly depending portion, and retaining means secured to said downwardly projecting portion and selectively pivotable relative thereto for engaging a selected surface of the upright and thereby selectively retaining said bracket means in a selected angular orientation, whereby said module may be oriented horizontally or tilted downwardly and forwardly at a desired angle;

a merchandise organization module defining at least one merchandise supporting surface for accommodating merchandise if varying widths;

support means slidably secured to said bracket means for supporting said merchandise organization module and positioning said module at a selected distance from the upright; and locking means for retaining said support means in a desired position relative to said bracket means and the upright.

3. A shelf assembly according to claim 2, wherein said rearwardly projecting portion is disposed in a vertical plane and defines a plurality of notches on a lower surface thereof and wherein a range of bracket orientations is established by aligning one of the notches with an interior wall of an upright slot and thereby adjusting the spacing between a rear edge of said downwardly depending portion and the upright.

4. A shelf assembly according to claim 3, wherein said downwardly depending portion defines an aperture and wherein said retaining means comprises a plate member having at least one surface engageable with the upright and defining a slot alignable with said aperture and means insertable into said slot and aperture for retaining said plate member at a desired annular orientation.

5. A shelf assembly according to claim 4, wherein said plate member includes an upwardly angled portion, said at least one engageable surface being disposed along an edge surface of said upwardly angled portion.

6. A shelf assembly according to claim 5, wherein said upwardly angled portion defines a transverse slot extending across an edge surface thereof.

7. A shelf assembly according to claim 2, wherein said bracket means further includes a transverse member defining an axial opening at respective ends thereof and wherein each bracket assembly further includes an elongate portion slidably positionable within said transverse member whereby the distance between said flange sections may adjusted to accommodate uprights having various widths and various distances between columns of slots.

8. A shelf assembly for supporting merchandise on a gondola display rack, said rack having at least one vertically extending upright defining a column of vertically spaced slots therein, comprising:

bracket means selectively engageable with the slots of the upright and selectively angularly positionable relative thereto;

a merchandise organization module defining at least one merchandise supporting surface and including movable dividing means slidable transversely relative to said merchandise supporting surface for accommodating merchandise of varying widths said merchandise organization module defining a pair of transversely extending axial channels and said dividing means comprising a plurality of dividing members, each dividing member including a base section having a downwardly extending tab at each end slidably positionable within said axial channels and a panel section extending upwardly from said base section, whereby the dividing members may be slidably positioned along said channels relative to one another to define a plurality of columns of different widths and to thereby accommodate merchandise of varying dimensions;

support means slidably secured to said bracket means for supporting said merchandise organization module and positioning said module at a selected distance from the upright; and locking means for retaining said support means in a desired position relative to said bracket means and the upright.

9. A shelf assembly according to claim 8, wherein said merchandise organization module further includes a pusher assembly, said pusher assembly including a channel section having a spring biased pusher slidably disposed thereon and downwardly extending tabs at opposite ends thereof for slidable movement within corresponding axial slots.

10. A shelf assembly for supporting merchandise on a gondola display rack, said rack having at least one vertically extending upright defining a column of vertically spaced slots therein, comprising:

bracket means including first and second bracket assemblies, each of said bracket assemblies including a flange section having a rearwardly projecting portion insertable into one of said vertically spaced slots and a downwardly depending portion, and retaining means secured to said downwardly projecting portion and selectively pivotable relative thereto for engaging a selected surface of the upright and thereby selectively retaining said bracket means in a selected angular orientation;

a merchandise organization module defining at least one merchandise supporting surface and including movable dividing means slidable transversely relative to said merchandise supporting surface for accommodating merchandise of varying widths;

support means slidably secured to said bracket means for supporting said merchandise organization module and positioning said module at a selected distance from the upright; and locking means for retaining said support means in a desired position relative to said bracket means and the upright.

11. A shelf assembly according to claim 10, wherein said bracket means further includes a transverse member defining an axial opening at respective ends thereof and wherein each bracket assembly further includes an elongate portion slidably positionable within said transverse member whereby the distance between said flange sections may adjusted to accommodate uprights of various widths and having various spacings between columns of slots thereof.

12. A shelf assembly according to claim 10, wherein said bracket means further includes rails and said support means includes first and second channel members dimensioned and arranged to slidably receive said rails.

13. A shelf assembly according to claim 10, wherein said support means further comprises means for positioning said supporting surface at a plurality of selected distances from said upright.

14. A shelf assembly according to claim 10, wherein said support means comprises a pair of transversely extending track members and wherein said movable dividing means includes a plurality of dividing members slidably positionable along said track members.

15. A shelf assembly according to claim 12, wherein said bracket means further comprises a pair of parallel bracket members, each of said bracket members having an inwardly directed face for supporting a respective one of said rails and each of said bracket members having a plurality of aligned, spaced apart notches.

16. A shelf assembly according to claim 15, wherein said locking means includes a wire grid pivotably secured to said channel members and biasing means for biasing said wire grid into engagement with an aligned pair of said spaced apart notches.

17. A shelf assembly according to claim 16, wherein said support means further comprises a rectangular frame secured to said channel members, said rectangular frame defining a pair of transverse support surfaces and a pair of vertical support surfaces.

* * * * *